United States Patent [19]

Peck

[11] Patent Number: 4,862,529

[45] Date of Patent: Sep. 5, 1989

[54] HOSPITAL BED CONVERTIBLE TO CHAIR

[75] Inventor: William H. Peck, Oldenburg, Ind.

[73] Assignee: Hill-Rom Company, Inc., Batesville, Ind.

[21] Appl. No.: 218,293

[22] Filed: Jul. 13, 1988

[51] Int. Cl.[4] ..... A61G 7/00

[52] U.S. Cl. ..... 5/63; 5/67; 5/68

[58] Field of Search ..... 5/62, 63, 66, 67, 68, 5/69; 297/68, 75

[56] References Cited

U.S. PATENT DOCUMENTS

| | | | |
|---|---|---|---|
| 1,398,203 | 11/1921 | Schmidt | 5/66 |
| 2,308,592 | 1/1943 | Drexler et al. | 5/69 X |
| 3,032,059 | 5/1962 | Mc Leod | 5/67 X |
| 3,038,174 | 6/1962 | Brown et al. | 5/63 |
| 3,210,779 | 10/1965 | Herbold | 5/66 |
| 3,281,141 | 10/1966 | Smiley | 5/69 X |
| 3,593,350 | 7/1971 | Knight | 5/68 X |
| 4,227,269 | 10/1980 | Johnston | 5/68 X |
| 4,639,954 | 2/1987 | Speed | 5/69 X |
| 4,751,754 | 6/1988 | Bailey et al. | 5/69 X |

*Primary Examiner*—Gary L. Smith
*Assistant Examiner*—Michael J. Milano
*Attorney, Agent, or Firm*—Wood, Herron & Evans

[57] ABSTRACT

A bed that is convertible to a chair. The bed has a retracting frame mounted on a fixed frame. A patient support is formed by serially-connected head, seat, thigh, calf and foot panels, with the seat panel being fixed to the retracting frame. Movement of the retracting frame toward the foot end of the bed causes the head panel to rise and the leg panel to drop, thereby creating a chair.

20 Claims, 5 Drawing Sheets

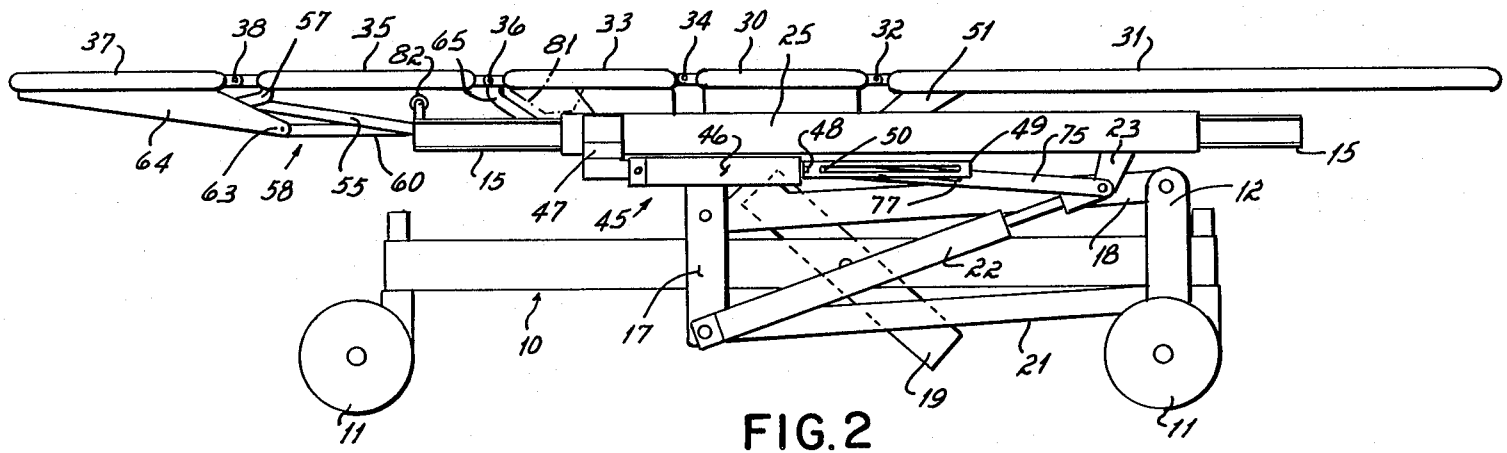
FIG. 2
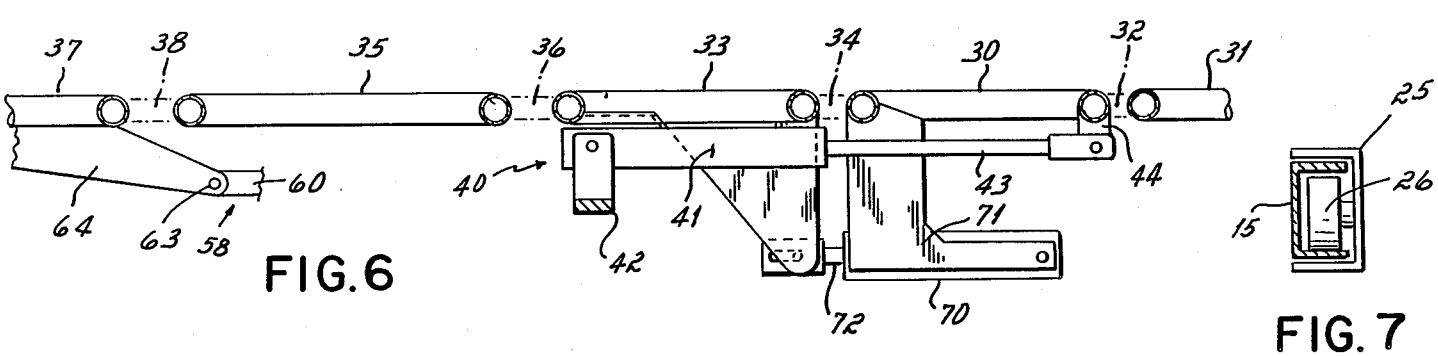
FIG. 7
FIG. 6

HOSPITAL BED CONVERTIBLE TO CHAIR

BACKGROUND OF THE INVENTION

This invention relates to a hospital bed that is convertible to a chair. The structure of the present invention is primarily useful for facilitating getting a patient from a supine position on the bed to a standing and/or walking position.

In the present practice, two nurses are preferably employed in assisting a patient's moving from a supine position to a standing position. This is particularly true for a patient who has been in the supine position for a long period of time. In many instances, the patient in that condition simply does not want to stand because it is painful.

To get the patient to a standing position, the bed is lowered. The side rails of the bed are dropped. The patient is then pivoted or swung through 90° so that the patient's legs hang over the side of the bed. Even in its lowered position, the patient's feet most likely will not rest firmly on the floor. Therefore, in addition to hurting, the patient is apprehensive about sliding off the bed without knowing when his feet will touch the floor.

In this attitude, attendants assist the patient in getting his feet on the floor as he slides off the bed. The attendants cannot lift directly since they are at the edge of the bed and the patient's weight is centered inward of the edge of the bed. If the patient should start to fall, the attendant must hold the patient firmly while at the same time bracing himself in a somewhat awkward position. This movement will sometimes lead to back injury of the attendant.

BRIEF DESCRIPTION OF THE INVENTION

An objective of the present invention has been to convert a hospital bed to a chair with the conventional head panel of the hospital bed functioning as the back of the chair so that the patient can exit the bed from the foot of the bed. By providing for conversion to a chair in this fashion, the patient can simply be eased into an upright sitting position from which exit from the chair is easily achieved with attendants at the side of the "chair" in a much more favorable position for lifting or supporting the patient.

Another objective of the invention has been to provide a foot panel in addition to the conventional patient support panels, that is, the head, seat, thigh and calf panels normally found in hospital beds. A foot panel is maintained in a horizontal position as the panels are shifted from bed to chair position so that as the patient is moved gently to a sitting position, the foot panel swings into engagement with the patient's feet, thereby giving the patient a sense of security, that is, being under control and not having dangling feet that must somehow reach the floor.

Still another objective of the present invention has been to provide for a hospital bed that converts to a chair while still providing the normal hospital bed articulating functions, specifically including the raising of the back and the raising of the patient's legs.

These objectives of the present invention are attained by providing a retracting frame on the normal bed fixed frame. The conventional seat panel is fixed to the retracting frame. The head panel is pivoted to one end of the seat panel. The thigh panel is pivoted at the other end of the seat panel, the calf panel is pivoted to the thigh panel and the foot panel is pivoted to the calf panel. Control links are connected between the fixed frame and the thigh panel, and a hydraulic cylinder and piston are provided for moving the retracting frame longitudinally with respect to the fixed frame, that movement causing the back panel to pivot upwardly and the calf panel to pivot downwardly. The control links also serve to hold the calf panel in a horizontal attitude when the patient support is in a bed position.

A parallelogram type linkage between the seat panel and the foot panel maintains the foot panel in a horizontal attitude at all positions of the patient support panels.

The parallelogram type linkage is in two sections which are pivotally interconnected at an intermediate floating link. The floating link permits a fixture of the parallelogram type linkage to permit the intermediate thigh panel to be angled upwardly to raise the patient's legs in the bed position, and to permit the calf panel to drop down when going to the bed position.

A conventional hydraulic cylinder and piston is provided for raising the head panel during a normal bed operation when the patient simply wants to have his head and back raised for greater comfort. Slotted links connect the head panel to the power for bed conversion and power for seat conversion so that the head panel can be raised in either of the two operations without interference.

In the preferred form of the invention, the patient support panels are mounted on the basic cantilever structure of patent application Ser. No. 7-034,232, filed Apr, 2, 1987, the disclosure for which is fully incorporated herein by reference. That basic base structure is designed to receive a variety of types of beds. The base consists of a base frame that is mounted on casters. A cantilevered support arm and stabilizing frame form a parallelogram linkage that is secured at one end to the foot end of the base frame. The upper end of the parallelogram linkage is connected to a fixed frame. In the conventional bed, four panels forming the patient support are supported on the fixed frame with the leg panels overlying the foot end of the base frame.

In using the base frame with the present invention, the retracting frame is mounted on the fixed frame and the seat panel is fixed to the retracting frame. The orientation of the patient support panels is reversed so that the foot end of the patient support panels projects beyond the upper end of the parallelogram linkage permitting the calf and foot to swing down without interference from the parallelogram linkage.

In the preferred form of the invention, controls are provided that will prevent the patient from inadvertently converting the bed to a chair position. More specifically, the hydraulic system is such that the fluid must be pumped manually to change the panels to a chair configuration.

The several features of the invention will become more readily apparent from the following detailed description taken in conjunction with the accompanying drawings in which:

FIG. 2 is a side elevational view of the bed in its lower position with the panels horizontal;

FIG. 6 is a cross-sectional view taken along lines 6—6 of FIG. 5;

Figure 4:
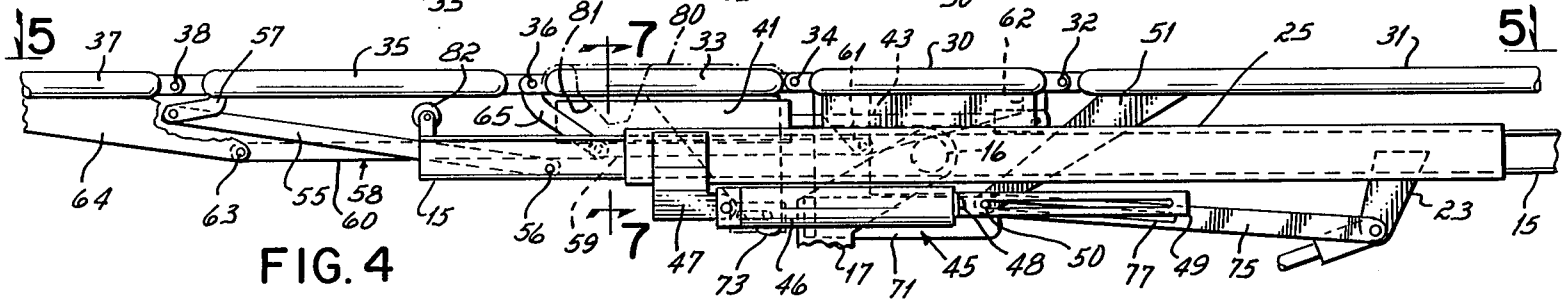
FIG. 4 is an enlarged fragmentary view similar to FIG. 2.
Figure 8:
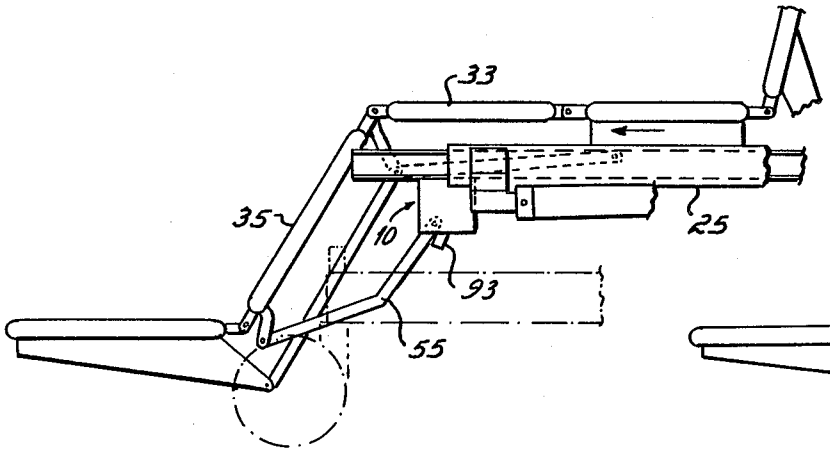

FIG. 7 s a cross-sectional view taken along lines 7—7 of FIG. 4;

FIG. 8 is a fragmentary side elevational view of an alternative embodiment; and

Figure 9:
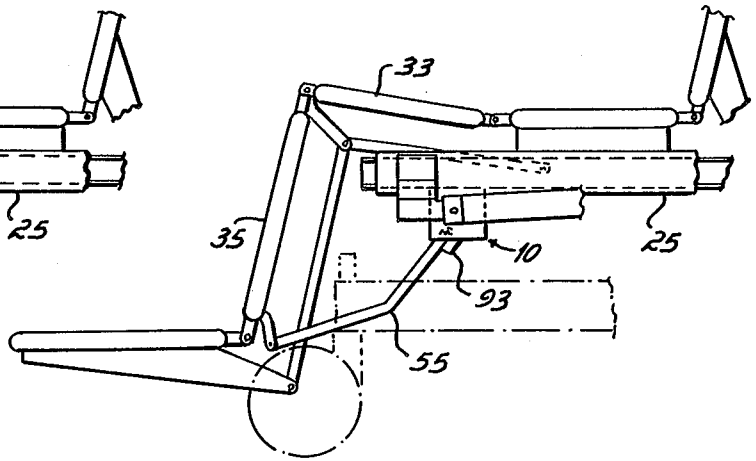

FIG. 9 is a view similar to FIG. 8 showing the thigh panel elevated position.

Figure 1:
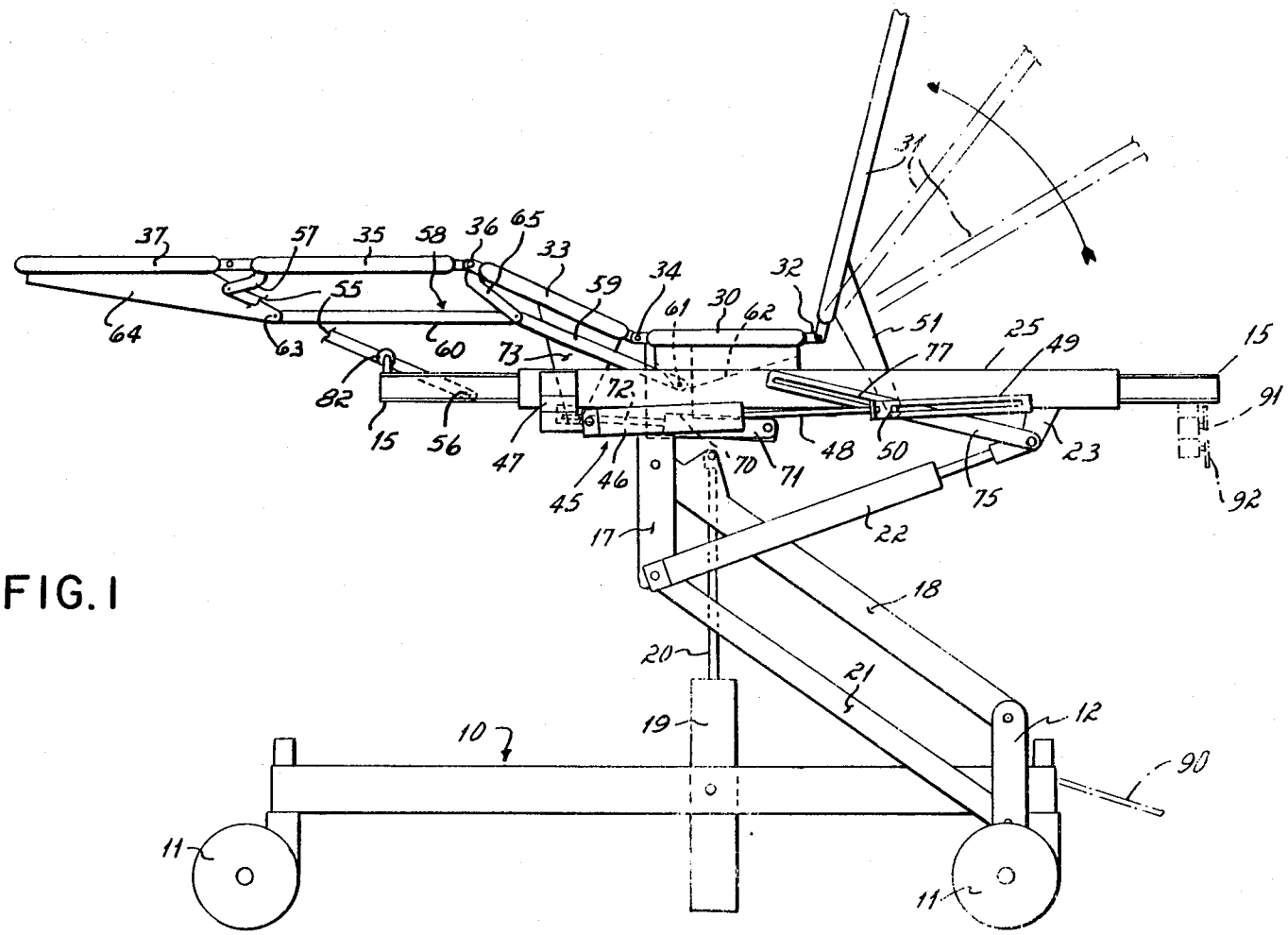
FIG. 1 is a side elevational view of the bed with panels in a sitting position.

Referring to FIG. 1, the bed has a base frame 10 supported on casters 11. The base 10 has an upwardly-projecting fixed bracket 12 at its head end. A fixed bed frame 15 is pivotally mounted at 16 (FIGS. 3 and 4) to a depending fixed bracket 17. A cantilevered support arm 18 is connected between the brackets 12 and 17. A hydraulic cylinder 19 is mounted on the base and has a piston rod 20 that engages the support arm 18 to raise and lower it. A stabilizing arm 21 is connected between the brackets 12 and 17 so that the arms 18 and 21 together with the brackets 12 and 17 provide a parallelogram linkage that supports the fixed frame 15 in a horizontal attitude whether the fixed frame is in a raised position as shown in FIG. 1 or in a lowered position as shown in FIG. 2. A piston and cylinder 22 is connected between bracket 17 and fixed frame 15, via bracket 23, to brace the fixed frame normally in a horizontal position. As the piston and cylinder 22 is retracted, the foot end of the fixed frame is raised, placing the bed into the trendelenburg position; if extended, the head end is raised to the reverse trendelenburg position. The base frame 10, the fixed frame 15, and the linkage and hydraulic cylinder to raise and lower the fixed frame with respect to the base frame corresponds to structure shown in copending application Ser. No. 7-034,232, filed Apr. 2, 1987.

A retracting frame 25 is slidably mounted on the fixed frame 15. Referring to FIG. 7, the retracting frame 25 is channel-shaped and carries at least rollers 26 at its four corners. The rollers cooperate with the fixed frame 15, which is channel-shaped and inside the channels of retracting frame 25, to support the retracting frame 25 on the fixed frame with the capability of movement with respect to the fixed frame.

A seat panel 30 is fixedly secured to the retracting frame 25. A head panel 31 is pivotally connected by a hinge 32 to the seat panel 30. A thigh panel 33 is connected by a hinge 34 to the seat panel 30. A calf panel 35 is connected by a hinge 36 to the thigh panel 33 and a foot panel 37 is connected by a hinge 38 to the calf panel 35. A centrally mounted double-acting piston and cylinder 40 is connected between the fixed frame 15 and the retracting frame 25. More specifically, a cylinder 41 is pivoted to a cross member 42 that forms part of the fixed frame 15. A piston rod 43 is pivotally connected to a bracket 44 that depends from the seat panel 30, the seat panel 30 being fixed to the retracting frame 25.

The patient support panels are connected to piston and cylinders for conventional bed operation, as will be described. A pair of pistons and cylinders 45 are pivotally mounted at each side of the retracting frame 25. A cylinder 46 is mounted to a bracket 47 fixed to the retracting frame 25. A piston rod 48 is connected to a slotted bed link 49 that receives a pin 50 fixed to a bracket 51, the bracket 51 being fixed to the head panel 31 of the patient support. When the retracting frame 25 is in its retracted position as shown in FIGS. 1, 2 and 4, an extension of the piston rod 48 will cause the link 49 to push upon pin 50, thereby rotating the bracket 51 and panel 31 from the position of FIG. 2 to the position of FIG. 1.

A control link 55 is pivotally connected at each side of the fixed frame between the fixed frame 15 at 56 and a bracket 57 fixed to the calf panel 35. When the retracting frame 25 is in its retracted position of FIG. 1, the control link 55 provides the support for the thigh and calf panels 33, 35, maintaining them in horizontal position.

Foot panel 37 is supported, on each of its sides, in horizontal position by a parallelogram type linkage 58 which includes thigh panel 33 and calf panel 35 on one side and links 59 and 60 on the other side. Link 59 is pivoted at 61 to a bracket 62 fixed to seat panel 30 and, hence, to the retracting frame 25. Link 60 is pivoted at 63 to a bracket 64 fixed to the foot panel 37. A floater link 65 is pivotally connected between the thigh and calf panels 33 and 35 and the two links 59, 60, respectively, to maintain the parallelogram type linkage relationship (creating two end-to-end parallelogram linkages having the common link 65) while permitting panels 33 and 35 to flex with respect to each other, as shown in FIG. 1. A piston and cylinder 70 is pivotally mounted on a bracket 71 fixed to the seat panel 30 and hence to the retracting frame 25. The piston has a rod 72 pivoted to a bracket 73 fixed to the thigh panel 33. When the piston and cylinder 70 is actuated, the thigh panel 33 will rotate clockwise as shown in FIG. 1 to raise the thigh panel 33, calf panel 35, and foot panel 37 to the attitude shown in FIG. 1.

Thus, through the actuation of the piston and cylinder 45, conventional head panel operation is obtained and through the actuation of the piston and cylinder 70, conventional operation of the thigh and calf panels is obtained, with the control link 55 providing the necessary support and mechanical lift for the thigh and calf panels.

Figure 3:
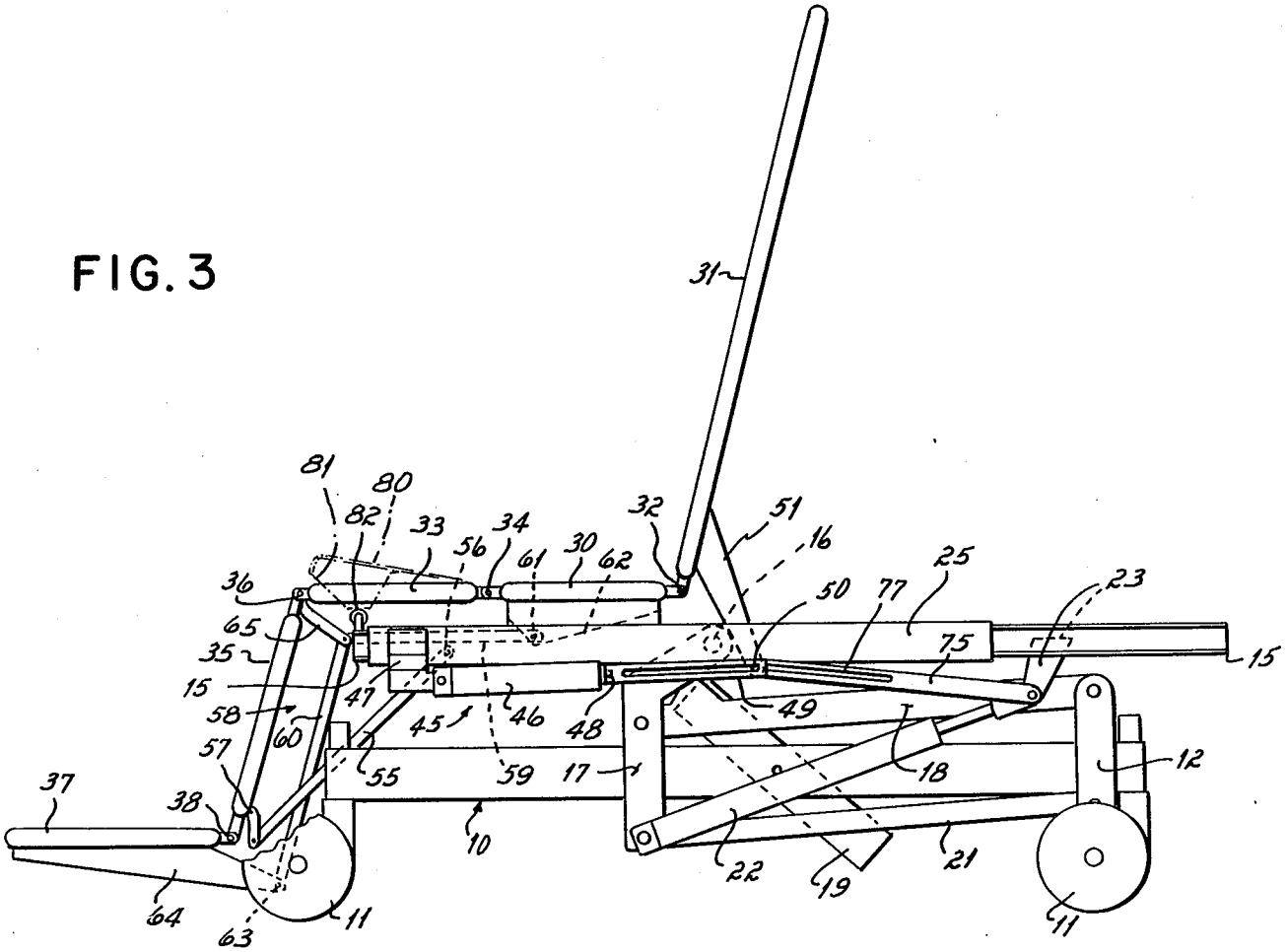
FIG. 3 is a side elevational view of the bed converted to a chair position.
Figure 5:
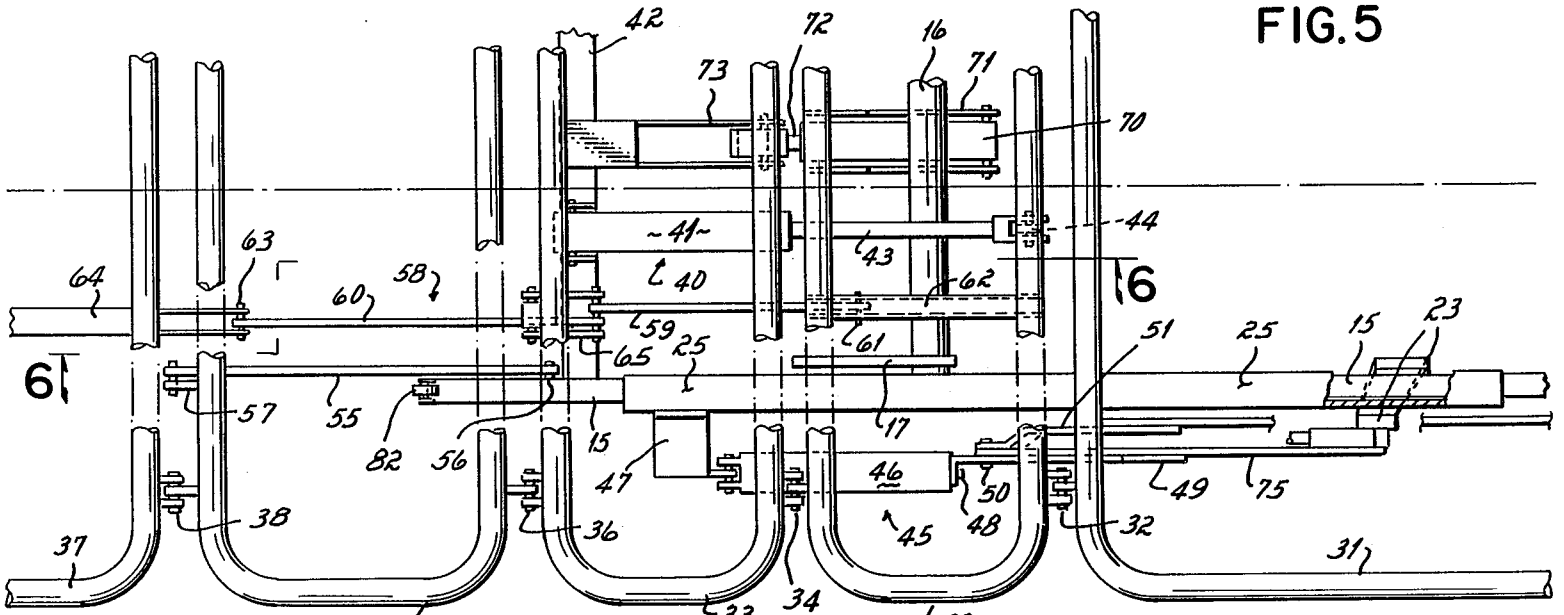
FIG. 5 is a fragmentary plan view taken in the direction of arrows 5—5 of FIG. 4.

A slotted chair link 75 is pivoted to the bracket 23 fixed to the fixed frame 15. The link 75 has a slot 77 which receives the pin 50 connected to the head panel bracket 51. As shown in FIGS. 2 and 4, the pin 50 is at the left-hand of the slot 77 when the patient support panels are all in a horizontal attitude. When the retracting frame 25 is extended, that is, driven to the left (compare FIGS. 2 and 4 with FIG. 3), the seat panel 30 fixed to frame 25 will pull the head panel 31 and its bracket 51 against the link 75, thereby causing the head panel 31 to pivot to a generally vertical attitude as shown in FIG. 3. The slot in the link 49 also permits the pin 50 to slide the extent necessary to raise the head panel 31.

When the retracting frame 25 moves to the foot end of the fixed frame, as shown in FIG. 3, the control link 55 will cause the calf panel 35 to swing down to a slightly inclined but generally vertical attitude. The foot panel 37 will remain horizontal due to the parallelogram linkage 58 connecting it to the seat panel 30.

Each of the patient support panels has a rigid cover removably mounted on the panel. The cover for the thigh panel 33 is shown at 80. Mattress cushions (not shown) will overlie the panel covers for the patient's comfort. The panel cover 80 has on its undersurface one or more cam tracks 81. One or more rollers 82 mounted on the fixed frame 15 is engageable by the cam track 81 so that when the retracting frame 25 is moved to the extended position, the roller operating on the cam track 81 will cause the panel 80 to pivot upwardly, thereby raising the patient's thighs so that the patient will not think he or she is sliding off the bed prematurely. In an alternative structure, a roller similar to roller 82 could be provided to act on a cam on the thigh panel 33, thereby raising the thigh panel 33 directly when the retracting frame 25 is operated.

A further alternative embodiment of apparatus for lifting the thigh panel when converting to a chair position is illustrated in FIGS. 8 and 9. There, a stop 93 extends across the frame 10 adjacent the control link 55. The stop 93 restricts the downward pivoting movement of the control link 55 and is positioned so as to be engaged by the control link 55 before the calf and foot panels reach their final position.

The relationship of the elements at the time the control link 55 contacts the stop 93 is illustrated in FIG. 8. Thereafter, the retracting frame 25 slides forward an additional two inches or so. In that forward thrust, the end of the now immobile control link 55 acts as a fulcrum about which the calf panel 35 pivots. As the calf panel 35 swings upwardly from the position of FIG. 8 to the position of FIG. 9, it inevitably raises the thigh panel 33 to an upwardly-inclined position to provide the patient with the comfortable feeling that he or she will not slide off the bed prematurely.

Thus, it can be seen from FIG. 3 that by simply extending the retracting frame 25, the patient support can be changed from a horizontal bed attitude to an upright chair attitude In this attitude, the foot panel 37 is about 4 inches above floor level. The patient's feet will normally be on the foot panel so that the patient has the security of knowing that he or she will not be involved in a free fall while sliding off the bed in order to get to a standing position.

If the structure of patent application Ser. No. 7-034,232 is compared with the structure disclosed herein, it will be seen that in the bed of the '232 patent application, the foot end of the patient support overlies the connection of the cantilevered support arm to the base frame. With that configuration, the patient's chest is available for X-rays. That attitude would not be suitable for the chair-bed configuration because the cantilevered support structure would impede the lowering of the foot, calf and thigh panels. Accordingly, the attitude of the panels is reversed with respect to the base frame.

In the preferred form of the invention, the hydraulic cylinder 41 that causes the movement of the retracting frame 25 is preferably operated by a foot pump 90 so that only an attendant can change the bed to the chair attitude of FIG. 3. A selector valve 91 is provided to switch the system to a chair mode of operation (using a hydraulic system similar to that of the '232 application), and another selector valve 92 is provided to switch the double-acting cylinder 41 to either an "up" mode of operation or a "down" mode of operation once the choice has been made to switch the system to the chair mode of operation.

In the operation of the invention, the cylinder 19 is actuated to raise the bed to a normal bed height. In that raised position, the panels may be completely horizontal or can be changed to a sitting-up position as shown in FIG. 1. That change is effected by operating the cylinder 46 to raise the head panel 31 by pushing on bracket 51. That movement of bracket 51 is permitted by the slot 77 in link 75. The thigh panel 33 may be independently raised by actuation of the cylinder 70.

If the patient is to be assisted from the bed, the bed is lowered to the position of FIG. 2. The retracting frame 25 is extended with respect to the fixed frame. In extending the retracting frame 25, two articulations of the patient support panels occur. Head panel 31 is swung to an upright position by the bracket 51 being pulled against the end of the slot 77 in link 75. The slot in the link 49 permits that movement.

The control link 55, coupled with the movement of the seat panel 30 forward, causes the calf panel 35 to swing downwardly, carrying with it the foot panel 37. The foot panel 37 is maintained in a horizontal attitude because of the parallelogram type linkage 58 connecting it to the seat panel 30. The thigh panel cover 80 is raised slightly by cam track 81 rolling upon roller 82 so as to raise the patient's thighs slightly to provide the comfort of knowing that the patient will not slide off the chair.

With the patient in a sitting up position, attendants at either side of the patient, who can stand quite close to the patient because of the narrowness of the patient's bed, can ease the patient to a standing position. Since the patient's feet are in contact with the foot panel 37, the patient's fear of falling to the floor is minimized. Once the patient is standing, it is of course a very short step, approximately four inches, to the floor in front of the bed.

From the above disclosure of the general principles of the present invention and the preceding detailed description of a preferred embodiment, those skilled in the art will readily comprehend the various modifications to which the present invention is susceptible. Therefore, I desire to be limited only by the scope of the following claims and equivalents thereof:

I claim:

1. A bed that converts to a chair comprising,
a base including a fixed horizontal frame,
a patient support consisting of serially-hinged, normally horizontal head, seat, thigh and calf panels,
means mounting said patient support on said fixed frame,
first power means for pivoting said head panel upwardly so as patient can sit up comfortably in bed,
second power means for pivoting said head panel upwardly and swinging said calf panel down to an approximately vertical attitude to create a chair configuration of said panels.

2. A bed as in claim 1 further comprising a cover for said thigh panel, and means for raising said thigh panel cover as said calf panel is swung down.

3. A bed as in claim 1 further comprising,
a foot panel hinged to said calf panel,
means for maintaining said foot panel horizontal as said calf panel is swung down.

4. A bed that converts to a chair comprising,
a base frame having head and foot ends and casters supporting said base frame above a floor,
an upwardly-inclined parallelogram support linkage pivotally connected at its lower end to said base frame at the head end of said base frame,
a fixed frame connected to the upper end of said support linkage,
a patient support consisting of serially-hinged, normally horizontal head, seat, thigh, calf and foot panels, said head panel overlying the head end of said base frame,
means mounting said patient support on said fixed frame,
power and linkage means for raising said head panel and swinging said calf and foot panels downwardly while maintaining said foot panel horizontal.

5. A bed as in claim 4 in which said power and linkage means swings said foot panel horizontally beyond and vertically below said base frame so that a patient may easily step from said foot panel to the floor.

6. A bed as in claim 4 in which said foot panel, in its lowered position, is no more than about four inches above the floor.

7. A bed that converts to a chair comprising, a base including a fixed frame having a head end and a foot end, a retracting frame slidably mounted on said fixed frame for movement between a bed position and a chair position wherein said retracting frame has moved toward said foot end of said fixed frame, chair power means for retracting said retracting frame between its two positions, a patient support consisting of serially hinged, normally horizontal head, seat, thigh, calf and foot panels, said seat panel being fixed to said retracting frame, and said foot panel being adjacent the foot end of said fixed frame, a pair of control links pivotally connected between said fixed frame and the end of said calf panel adjacent said foot panel, said control links causing said calf panel to swing downwardly when said retracting frame is moved toward the foot end of said fixed frame.

8. A bed as in claim 7 further comprising, a chair link between said fixed frame and said head panel to pivot said head panel upwardly when said retracting frame is moved toward the foot end of said fixed frame.

9. A bed as in claim 8 further comprising, bed power means and a bed link between said head panel and bed power means to raise said head panel when bed power means thrusts said linkage toward the head end of said bed, said chair link and said bed link having slotted connections to said head panel, said slotted connection permitting each link to pivot said head panel without interference from the other link.

10. A bed as in claim 7 further comprising, a parallelogram type linkage between said seat panel and said foot panel to maintain said foot panel horizontal as said retracting frame is retracted.

11. A bed as in claim 10 in which one side of said parallelogram type linkage consists of said thigh and calf panels, the other side of said parallelogram type linkage being formed by two links connected together on an intermediate pivot axis, and a floater link connected between said intermediate pivot axis and the connection between said thigh and calf panels.

12. A bed as in claim 7 further comprising means for raising the joint between thigh and calf panels causing said panels to pivot with respect to each other when said retracting frame is moved toward the foot end of said fixed frame.

13. A bed as in claim 11 in which said floater link permits pivotal movement between said thigh and calf panels.

14. A bed as in claim 7 in which said control links maintain said thigh, calf and foot panels in a generally horizontal attitude when said panels are aligned horizontally in a bed attitude.

15. A bed as in claim 7 further comprising, a bracket depending from said thigh panel, a piston and cylinder connected between said retracting frame and said depending bracket, said piston and cylinder, when extending, causing the thigh panel to angle upwardly to place the patient's legs in a comfortable position while the structure is in a bed attitude.

16. A bed as in claim 15 further comprising a parallelogram type linkage interconnecting said seat and foot panels, said parallelogram type linkage and control links maintaining said calf and foot panels in a horizontal attitude when said thigh panel is angled upwardly.

17. A bed that converts to a chair comprising, a base, a fixed frame mounted on said base, a retracting frame mounted on said fixed frame for movement between a forward position in which a chair is formed and a rearward position in which a bed is formed, serially-hinged head, seat, thigh, calf and foot panels, said seat panel being mounted on said retracting frame with said foot panel extending in a forward direction, a first piston and cylinder for upwardly pivoting said head panel when said retracting frame is in a rearward position and all remaining panels are substantially horizontal, a second piston and cylinder for pivoting said thigh panel upwardly when said retracting frame is in a rearward position, a third piston and cylinder for thrusting said retracting frame to its forward position, and linkage means for swinging said head panel upwardly, said calf panel downwardly and maintaining said foot panel parallel to said seat panel when said retracting frame is thrust to its forward position.

18. A bed as in claim 17 in which said linkage means comprises, a bracket depending from said back panel and presenting a lower end having a pin normally below the hinge connection between said seat panel and said back panel, said first piston and cylinder being connected by a first link having an elongated slot in which said pin is mounted, said first piston and cylinder being adapted to swing said head panel upwardly by pushing said first link against said pin, a second link having one end fixed to said fixed frame and having an elongated slot connected to said pin, said second link being operative to pull on said pin to swing said head panel upwardly when retracting frame is moved in a forward direction, said slots on said links preventing interference when said head panel is swung upwardly by either said first piston and cylinder or said forward movement of said retracting frame.

19. A bed as in claim 1 further comprising means for raising said thigh panel as said second power means pivots said back up and said calf panel down to create said chair configuration.

20. A bed as in claim 7 further comprising:

a stop on said fixed frame in the downward path of control links, said stop, when engaged by said control links, causing said thigh panel to swing upwardly as said calf panel swings to its lower position.

* * * * *

UNITED STATES PATENT AND TRADEMARK OFFICE

CERTIFICATE OF CORRECTION

PATENT NO. : 4,862,529

DATED : September 5, 1989

INVENTOR(S) : William H. Peck

It is certified that error appears in the above-identified patent and that said Letters Patent is hereby corrected as shown below:

Column 2, line 14, "fixture" should be -- flexure --

Column 3, line 5, "s" should be -- is --

Column 5, line 27, insert -- . -- after "attitude" (first occurrence).

Signed and Sealed this

Twenty-eighth Day of August, 1990

*Attest:*

HARRY F. MANBECK, JR.

*Attesting Officer*

*Commissioner of Patents and Trademarks*